US008937260B2

(12) United States Patent
Bonetti et al.

(10) Patent No.: US 8,937,260 B2
(45) Date of Patent: Jan. 20, 2015

(54) CONTROL MECHANISM FOR A CIRCUIT-BREAKING DEVICE AND A CIRCUIT-BREAKING DEVICE COMPRISING SAID MECHANISM

(75) Inventors: Luigi Bonetti, Bergamo (IT); Michele Ferrari, Bergamo (IT)

(73) Assignee: ABB S.p.A., Milan (IT)

( * ) Notice: Subject to any disclaimer, the term of this patent is extended or adjusted under 35 U.S.C. 154(b) by 684 days.

(21) Appl. No.: 13/142,704

(22) PCT Filed: Dec. 29, 2009

(86) PCT No.: PCT/EP2009/068009

§ 371 (c)(1),
(2), (4) Date: Jun. 29, 2011

(87) PCT Pub. No.: WO2010/079110

PCT Pub. Date: Jul. 15, 2010

(65) Prior Publication Data

US 2011/0266125 A1 Nov. 3, 2011

(30) Foreign Application Priority Data

Jan. 8, 2009 (IT) ..... MI2009A0009

(51) Int. Cl.

| | |
|---|---|
| ***H01H 3/46*** | (2006.01) |
| ***H01H 71/52*** | (2006.01) |
| *H01H 1/22* | (2006.01) |
| *H01H 71/10* | (2006.01) |

(52) U.S. Cl.

CPC ..... *H01H 71/525* (2013.01); *H01H 1/225* (2013.01); *H01H 3/46* (2013.01); *H01H 2071/1036* (2013.01)

USPC ..... 200/401

(58) Field of Classification Search

CPC ..... H01H 3/02; H01H 3/46; H01H 71/50; H01H 71/52

USPC ..... 200/400, 401, 321–339, 501, 237, 244

See application file for complete search history.

(56) References Cited

U.S. PATENT DOCUMENTS

| | | | |
|---|---|---|---|
| 4,489,299 | A | 12/1984 | Wien et al. |
| 4,951,020 | A | 8/1990 | Changle et al. |

(Continued)

FOREIGN PATENT DOCUMENTS

| | | | |
|---|---|---|---|
| CN | 101055821 | A | 10/2007 |
| GB | 2376800 | A | 12/2002 |

OTHER PUBLICATIONS

Translation of CN101055821 Description Franz Yutaka et al. Oct. 17, 2007.*

(Continued)

*Primary Examiner* — Amy Cohen Johnson
*Assistant Examiner* — Marina Fishman
(74) *Attorney, Agent, or Firm* — Novak Druce Connolly Bove + Quigg LLP

(57) ABSTRACT

The present invention relates to a control mechanism for the displacement of at least one moving contact of a low-voltage circuit-breaking device. The control mechanism comprises elastic means operatively connectable to the moving contact, at least a first element of which is operatively connected to a second element by means of pin-shaped connection means. The first and second elements each comprise a pair of facing lateral portions that are connected by a transverse portion. The pin-shaped connection means comprise a pair of pin-shaped ends, each of which emerges from one side of a lateral portion of the first element. Said pin-shaped means also comprise a pair of seats, each of which is defined on a lateral portion of the second element. Each pin-shaped end is inserted in a corresponding seat so as to configure an axis of mutual rotation between the first and the second elements. The elastic means are arranged so as to exert a retaining force on the pin-shaped ends sufficient to keep them coupled to the corresponding seats in which they are inserted.

6 Claims, 14 Drawing Sheets

(56) References Cited

U.S. PATENT DOCUMENTS 5,543,595 A * 8/1996 Mader et al. ..... 200/401
6,864,451 B1 * 3/2005 Slepian ..... 200/401
7,633,031 B2 * 12/2009 Wehrli et al. ..... 200/401

OTHER PUBLICATIONS

Chinese Office Action dated Feb. 27, 2014.

* cited by examiner (PRIOR ART)

(PRIOR ART)

CONTROL MECHANISM FOR A CIRCUIT-BREAKING DEVICE AND A CIRCUIT-BREAKING DEVICE COMPRISING SAID MECHANISM

CROSS REFERENCE TO RELATED APPLICATIONS

This application is a National Phase filing under 35 U.S.C. §371 of PCT/EP2009/068009 filed on Dec. 29, 2009; and this application claims priority to Application No. MI2009A000009 filed in Italy on Jan. 8, 2009 under 35 U.S.C. §119; the entire contents of all are hereby incorporated by reference.

The present invention relates to a control mechanism for a circuit-breaking device for low-voltage systems. The present invention also relates to a circuit-breaking device comprising said control mechanism.

It is common knowledge that low-voltage circuit-breaking devices (i.e. in applications with working voltages up to 1000V AC/1500V DC), such as automatic circuit-breakers, isolators and contactors, generally called "switching devices" and hereinafter simply called circuit-breakers, are devices designed to enable the proper operation of specific parts of electric systems and of the installed loads. Automatic circuit-breakers, for instance, ensure that the required rated current can flow towards the various users, enabling the loads to be reliably connected to and disconnected from the circuit, and enabling the automatic isolation of the circuit being protected from the electrical energy source.

It is also well known that circuit-breakers comprise a housing, one or more electric poles, each of which is associated with at least one pair of contacts suitable for coupling and uncoupling with one another. The circuit-breakers of the known state of the art also comprise a control mechanism that induces a relative movement of the pairs of contacts so that they can occupy at least one coupled position (when the circuit-breaker is closed) and at least one uncoupled position (when the circuit-breaker is open). The control mechanism conventionally takes effect on the moving contacts by means of a main shaft operatively connected to the moving contacts, or by means of a moving part that operatively supports said moving contacts. The control mechanism conventionally comprises a supporting frame that supports a kinematic chain with at least one element operatively connected to the moving part to enable the latter's displacement.

The control mechanisms usually comprise at least one tripping element that is enabled by a protection device in the event of an anomaly in the circuit in which the circuit-breaker is installed, e.g. a short circuit or an overload. A protection device, such as a thermal, thermomagnetic or electronic device, directly or indirectly enables the kinematic chain of the control mechanism in order to induce a rapid separation of the contacts and the consequent automatic opening of the circuit-breaker.

FIG. 13 shows a conventional control mechanism (200) that interacts with a protection device (202) by means of a trip shaft. In the case illustrated, as in almost every case of the known solutions, the control mechanism's kinematic chain comprises a plurality of operative members (210), at least one of which is connected to the supporting frame (205) by means of a hinged joint consisting of a pin (201) supported on each end by the sides (211) of the frame (205). In almost all cases, the mutual connection between the other members in the kinematic chain is likewise achieved by means of hinged joints complete with pins.

It is common knowledge that, during the working life of a circuit-breaker, virtually every component is subject to wear and tear, as a result of the considerable thermal and mechanical stresses to which it is normally liable for instance, and particularly during circuit-breaking manoeuvres or tripping due to short circuits. The functionality of the circuit-breaker depends, however, on the perfect efficiency of all of its parts, and particularly of the hinged joints that constitute the control mechanism. It is consequently necessary for these members to be suitably sized in order to guarantee an adequate working life of the appliance. In particular, the hinged joints that must guarantee a perfect functionality and efficiency in the long term.

The known control mechanisms have several drawbacks, above all in terms of their reliability. These controls comprise a relatively large number of mechanical elements, especially hinged joints that are crucial particularly in terms of weight and cost. In addition, they restrict the opportunities to install other mechanical parts in the vicinity if the latter's movements might intercept the pins forming part of the hinges. Moreover, fixing the pins to the corresponding supporting means during the assembly of the appliance normally entails the application of further retaining elements, such as elastic rings, split rings (Benzing or Seeger) or plugs, and more or less laborious and complex mechanical procedures.

FIG. 14 shows a control mechanism comprising a supporting frame (205) to which an operative member (210) is pivotally connected by means of a transverse pin (201) the axial position of which is established with the aid of a plurality of retaining rings (215) of the type known as "Benzing" rings. FIG. 15 shows another, conceptually widely-known control mechanism (200) similar to the one in FIG. 2, except that retaining rings of the "Seeger" type (216) are used to axially block the transverse pin (201) in relation to the supporting frame (205). In both the cases illustrated, the assembly of the control mechanism is particularly tiresome because of the necessary presence of the retaining rings, the proper positioning of which demands a high precision. Another far from negligible problem relating to the use of retaining rings, and of small metal parts generally, lies in the risk of their dispersion. It is a well-known fact that any small metal parts, and rings in particular, can be accidentally dispersed, both during the assembly stages and at the time of any servicing, or because they become detached from their seats. It is also common knowledge that any such dispersed foreign metal parts can easily cause mechanical seizures, malfunctions or short-circuits, all circumstances that are hazardous in electrical applications. In fact a significant proportion of circuit-breaker failures are related to the unwanted presence of foreign metal parts.

The above-described technical demands have been translated into the custom of constructing relatively bulky controls containing a large number of components. These circumstances represent drawbacks that have a negative fallout on the global cost of manufacture and usage of the circuit-breakers. In a word, a contradiction has become apparent between the installation needs to increasingly miniaturise the circuit-breaker, reducing the number of components involved and the overall weight, and the need to increase or at least maintain its technical performance.

Based on these considerations, the principal aim of the present invention is to produce a control mechanism for a circuit-breaking device for use in low-voltage systems that enables the above-mentioned drawbacks to be overcome.

This aim is achieved by means of a control device according to the content of claim 1. Further advantageous features of the present invention are identified in the dependent claims.

The description that follows refers, exclusively for descriptive purposes, to a control mechanism installed in a single-switching multipolar circuit-breaking device for low-voltage systems. This is clearly on the understanding that the principles and technical solutions expounded in the description of the inventive concept also hold for other applications of the control mechanism, such as may be related to its use in double-switching circuit-breakers with a different number of poles.

Further characteristics and advantages will emerge more clearly from the description of a preferred, but not exclusive embodiment of the control mechanism according to the present invention, a non-limiting example of which is illustrated in the attached drawings, wherein.

Figure 1:
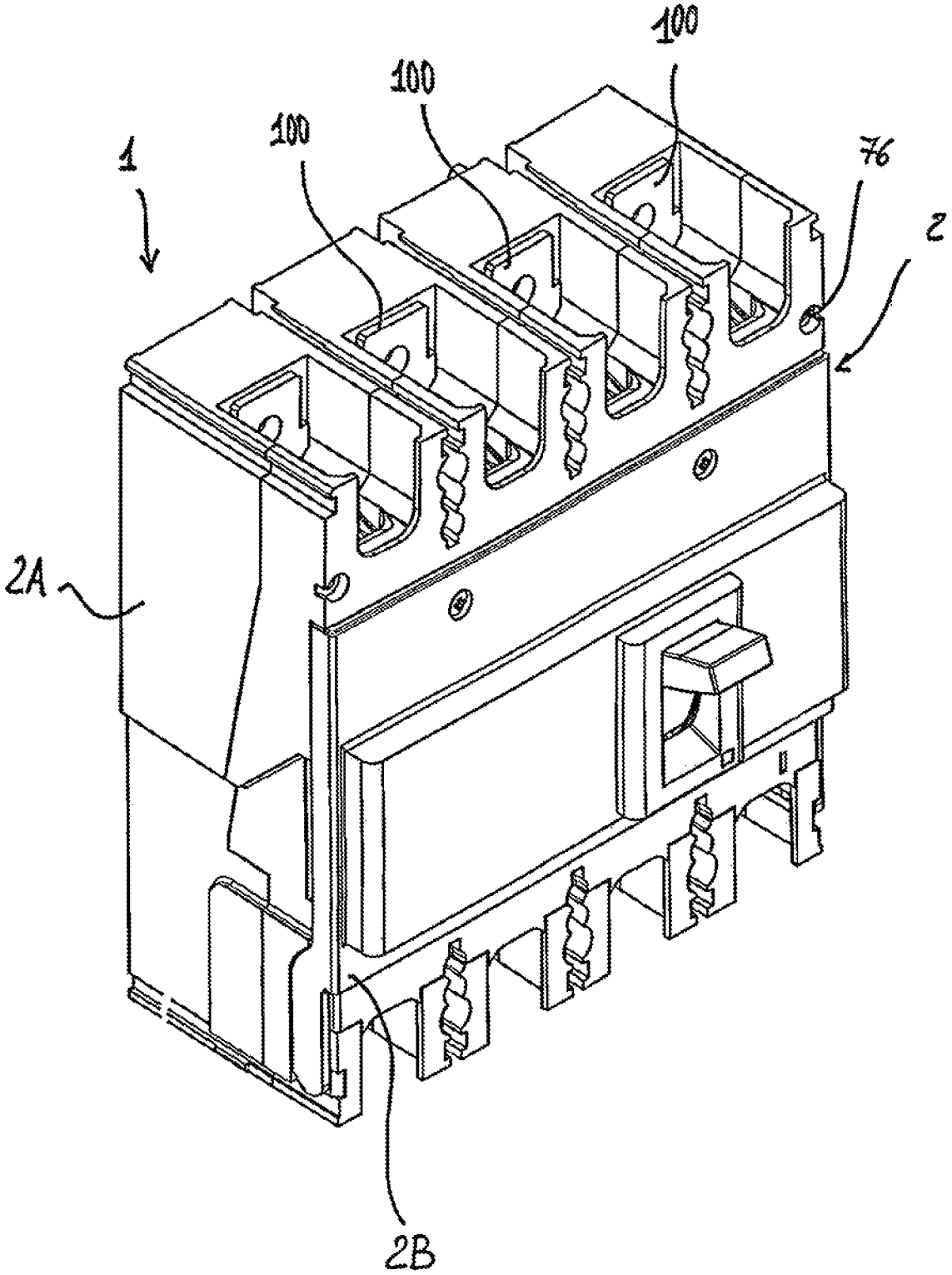
FIG. 1 is a perspective view of a circuit-breaker according to the present invention.
Figure 2:
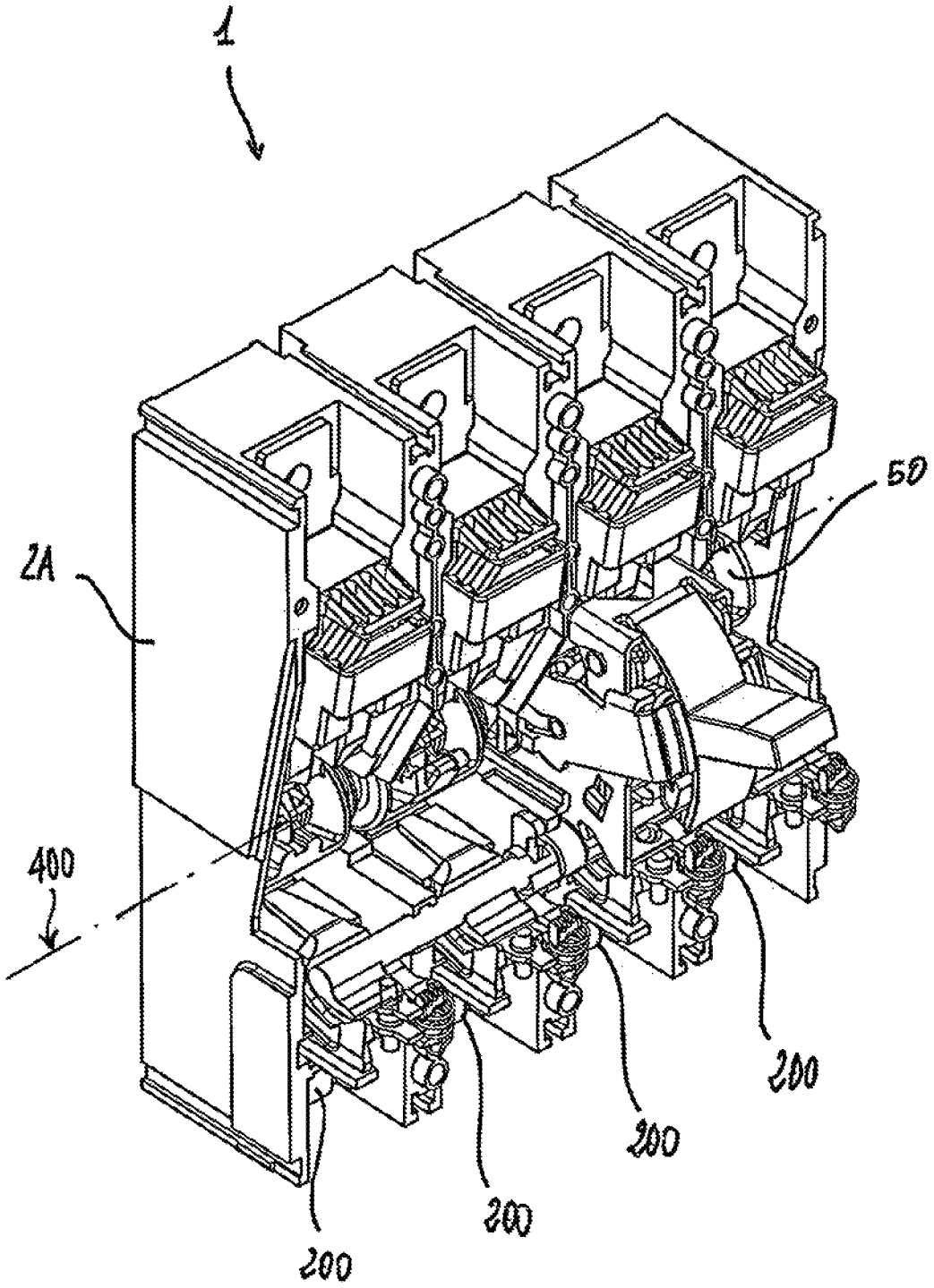
FIG. 2 is a perspective view of the circuit-breaker in FIG. 1, wherein the housing for containing the circuit-breaker has been partially removed.

FIG. 1 is a perspective view relating to a circuit-breaking device 1 according to the present invention. More precisely, in the example shown, the circuit-breaking device is an automatic circuit-breaker 1 comprising an external housing 2 consisting of a first shell 2A and a second shell 2B, which are coupled together by removable connection means 76, such as screws. The first shell 2A is shaped so as to contain a plurality of first electric terminals 100, each relating to one pole of the circuit-breaker 1. Each of said first electric terminals 100 is electrically connected to the fixed contact 10 of the corresponding pole. The first shell 2B is also shaped so as to contain second electric terminals 200 (see FIG. 2), each of which corresponds to one pole of the circuit-breaker 1 and the related protection devices. Each of the second electric terminals 200 is electrically connected to the moving contact 20 of the corresponding pole.

FIG. 2 is again a perspective view of the circuit-breaker in FIG. 1 with the second shell 2B removed, showing that the first shell 2A preferably supports a moving part 50, the purpose of which is to contain the moving contacts 20 of the circuit-breaker 1. More precisely, the moving part 50 comprises a shaped body complete with a seat designed to contain a moving contact for each pole of the circuit-breaker.

The circuit-breaking device 1 comprises a control mechanism 30 according to the present invention that is operatively connected to said at least one moving contact to enable the latter's displacement between one position in which it is coupled with the corresponding fixed contact and at least one position in which it is uncoupled therefrom. The control mechanism 30 comprises a plurality of elements 31,32,33,34,35,36 at least a first element of which is pivotally connected to a second element by pin-shaped connection means.

The first and second elements preferably each comprise a pair of facing lateral portions that are connected by a transverse connecting portion. The pin-shaped connection means comprise a pair of pin-shaped ends, each of which emerges from one side of a lateral portion of the first element. The pin-shaped connection means also comprise a pair of seats, each of which is defined on a lateral portion of the second element. The pin-shaped ends are inserted in the seats so as to configure an axis of mutual rotation between the first and the second elements, and thereby enable the rotation of one of said elements in relation to the other.

The control mechanism 30 comprises elastic means operatively connected to the moving contact 20 to accelerate its coupling and uncoupling with the fixed contact 10. According to the invention, these elastic means are arranged so that they exert a retaining force on the pin-shaped ends sufficient to keep them coupled with the corresponding seats in which they are inserted. Said retaining force basically prevents the pin-shaped ends from emerging from their seats during the normal operation of the circuit-breaking device 1. This ensures the stability of the control mechanism's structure and thereby also its functionality.

According to a preferred embodiment of the invention, the elastic means are configured so as to exert a force on the pin-shaped ends such that the corresponding axis of mutual rotation maintains a substantially fixed position with respect to the corresponding seats, meaning by this that the elastic means come to bear in such a manner that the pin-shaped ends undergo no displacement with respect to their corresponding seats, and vice versa. Basically, the only allowable movement remains the mutual rotation of the two elements around their axis of mutual rotation, which occurs substantially in a fixed position with respect to a reference system integral with one of said elements.

The control mechanism 30 preferably also comprises retaining means configured so as to prevent the pin-shaped ends from emerging from their seats during the assembly of the control mechanism 30. In practice, said second retaining means serve the purpose of facilitating the assembly of the control mechanism 30 by keeping the pin-shaped ends inside their respective seats. The use of such retaining means enables the separate assembly of the control mechanism 30. This facilitates the process of assembly of the circuit-breaking device 1 in that the control mechanism 30 can be defined in advance and in an entirely independent manner.

The pin-shaped ends are preferably made in one piece with the lateral portions of the first element, for instance by means of a metal or plastic moulding process. According to a first possible embodiment, the pin-shaped ends are configured so as to emerge each on one internal side of one of the lateral portions of the first element so that they are facing each other. According to this embodiment, each of the pin-shaped ends emerges from a corresponding lateral portion in the direction of the opposite lateral portion. As explained in more detail later on, with this embodiment the first and the second elements are connected in such a manner that the lateral portions of the second element come to be located operatively in between the lateral portions of the first element.

According to an alternative embodiment to the one described above, the pin-shaped ends are configured so that they each emerge from an external side of one of the lateral portions of the first element. In this second embodiment, the two elements are connected so that the lateral portions of the first element come to be located operatively in between the lateral portions of the second element.

In the embodiment shown in the figures, the control mechanism 30 is operatively connected to the moving contacts 20 by means of the moving part 50. More precisely, the control mechanism 30 takes effect on the moving part 50 to determine its rotation around its longitudinal axis 400, which is translated into a displacement of the moving contacts 20. More precisely, the control mechanism 30 occupies a first operative configuration (hereinafter called the closed configuration) as a result of which each moving contact 20 is coupled with a corresponding fixed contact 10. The control mechanism 30 occupies a second configuration determined by a manual action on one of its operative elements (the manual opening configuration), as a result of which each moving contact 20 is separated from its corresponding fixed contact 10. The control mechanism 30 can also occupy a third configuration determined by the tripping of a protection device 135 due to the occurrence of a malfunction, such as a short circuit on the line in which the circuit-breaker 1 is installed.

Figure 3:
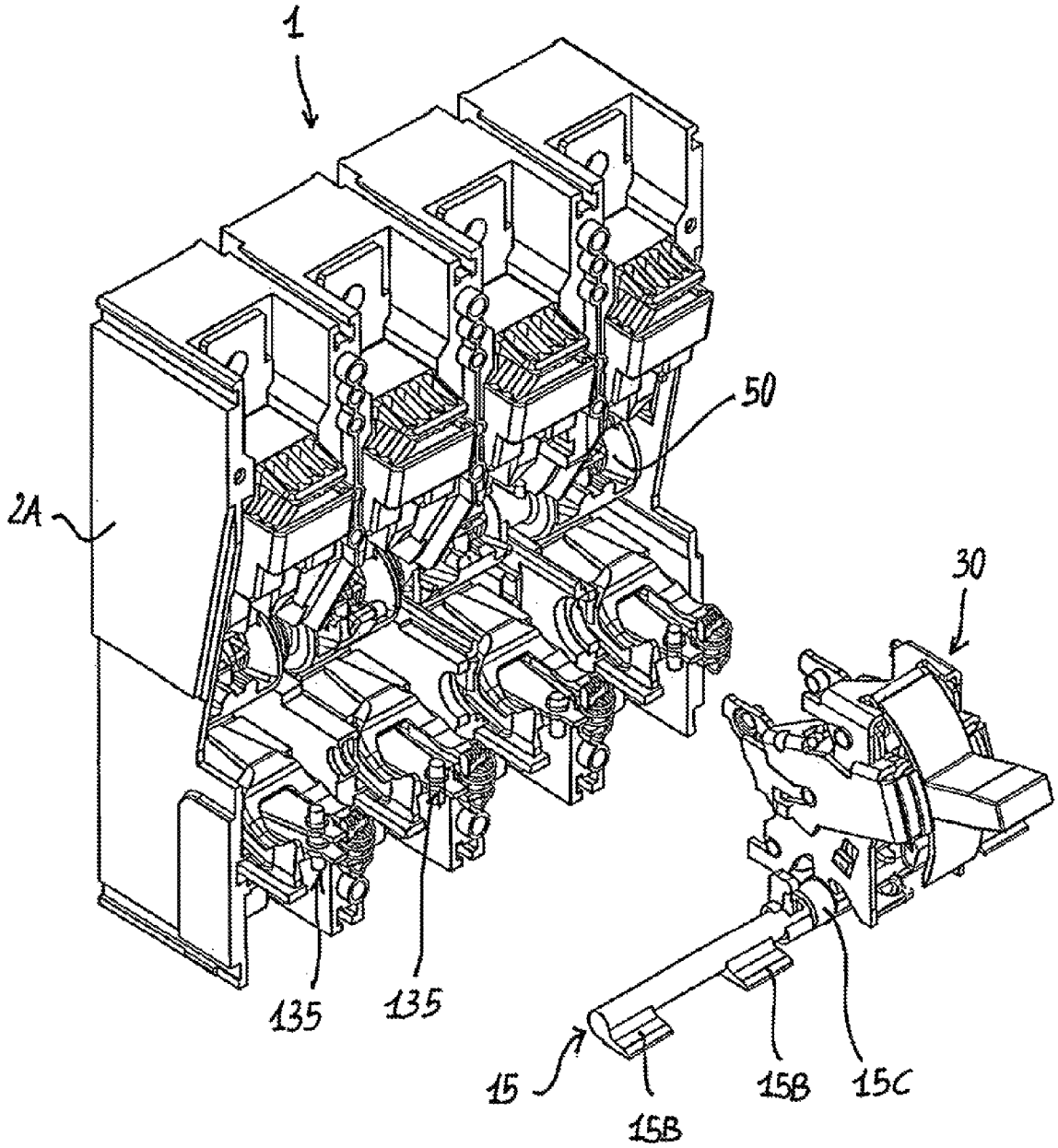
FIG. 3 is an exploded view of the circuit-breaker shown in FIG. 2.

With reference to the exploded view in FIG. 3, the protection device 135 is tripped by means of a control tripping device that, in the example illustrated, comprises a trip shaft 15, which is operatively connected to a tripping element 36 (see FIG. 4) for tripping the control mechanism 30, as a result of which the control mechanism switches from the closed configuration to the tripped configuration. As shown more clearly in FIG. 5, the trip shaft 15 comprises one or more enabling portions 15B, each of which is capable of interacting with one or more protection devices 135. More precisely, these protection devices 135 interact with the enabling portions 15B to cause a rotation of the trip shaft 15, that in turn determines a displacement of the tripping element 36. Said displacement is translated into a tripping of the control mechanism 30.

Figure 6:
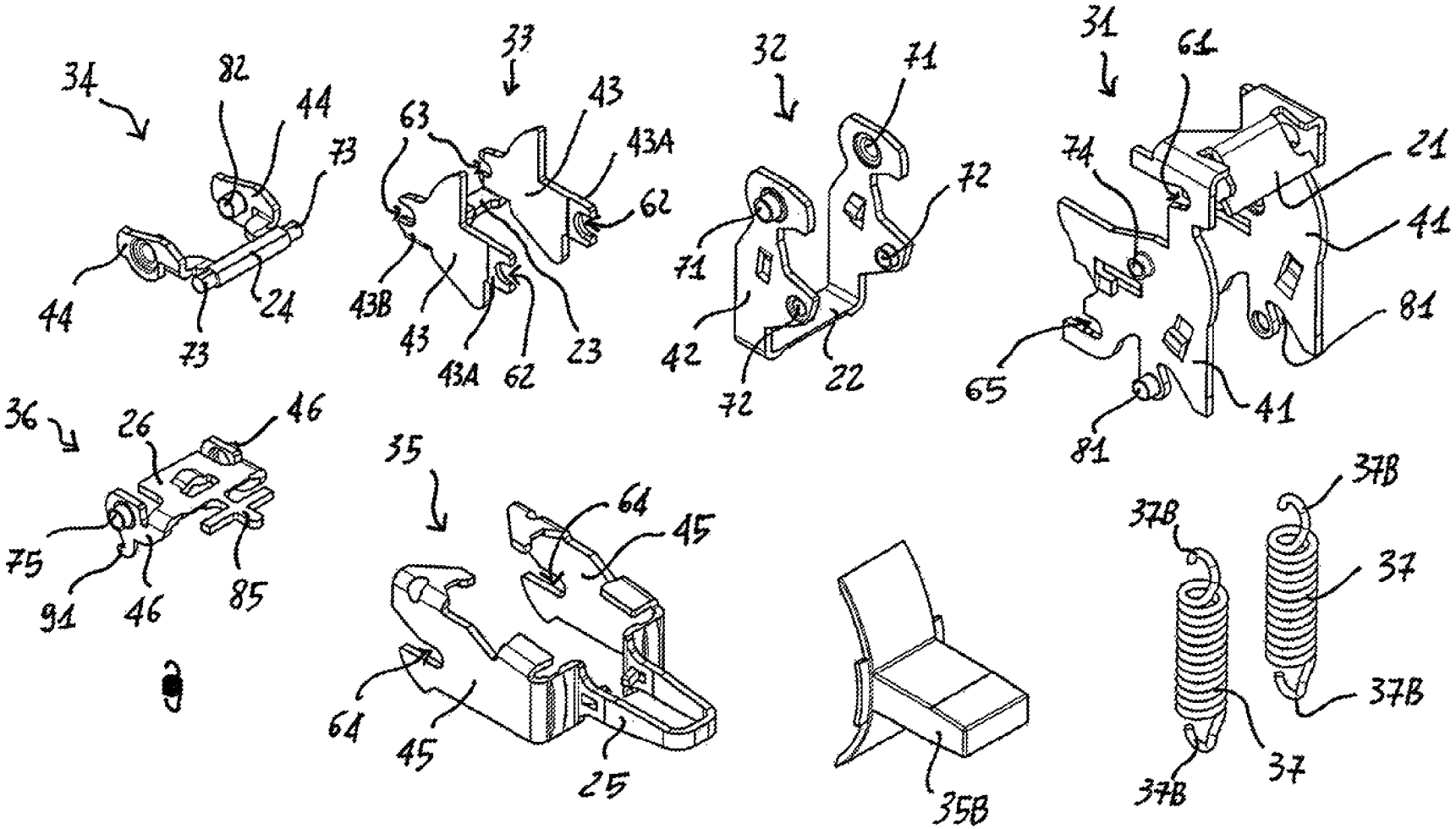
FIG. 6 is a view of the main components of the control mechanism shown in FIG. 4.

The elements of the control mechanism 30 are operatively connected so as to define at least one kinematic chain that takes effect on the moving contacts 20 by means of the moving part 50. FIG. 6 shows details of the elements of a kinematic chain in the control mechanism 30 shown in the figures. For the purposes of the present invention, the term kinematic chain is used to indicate a group of elements in the control mechanism that are coupled together to perform one of the functions (e.g. the manual or automatic opening) for which the mechanism was conceived. This means that there may be several kinematic chains in the control mechanism, each designed, for instance, to achieve one of these functions.

The control mechanism 30 comprises a supporting frame 31 consisting of a first pair of lateral supporting portions 41 connected by a first transverse connecting portion 21. The supporting frame 31 is basically the element that supports the kinematic chain in the mechanism and that maintains a substantially fixed position with respect to the housing 2 of the circuit-breaker during the operation of the control mechanism 30.

Figure 4:
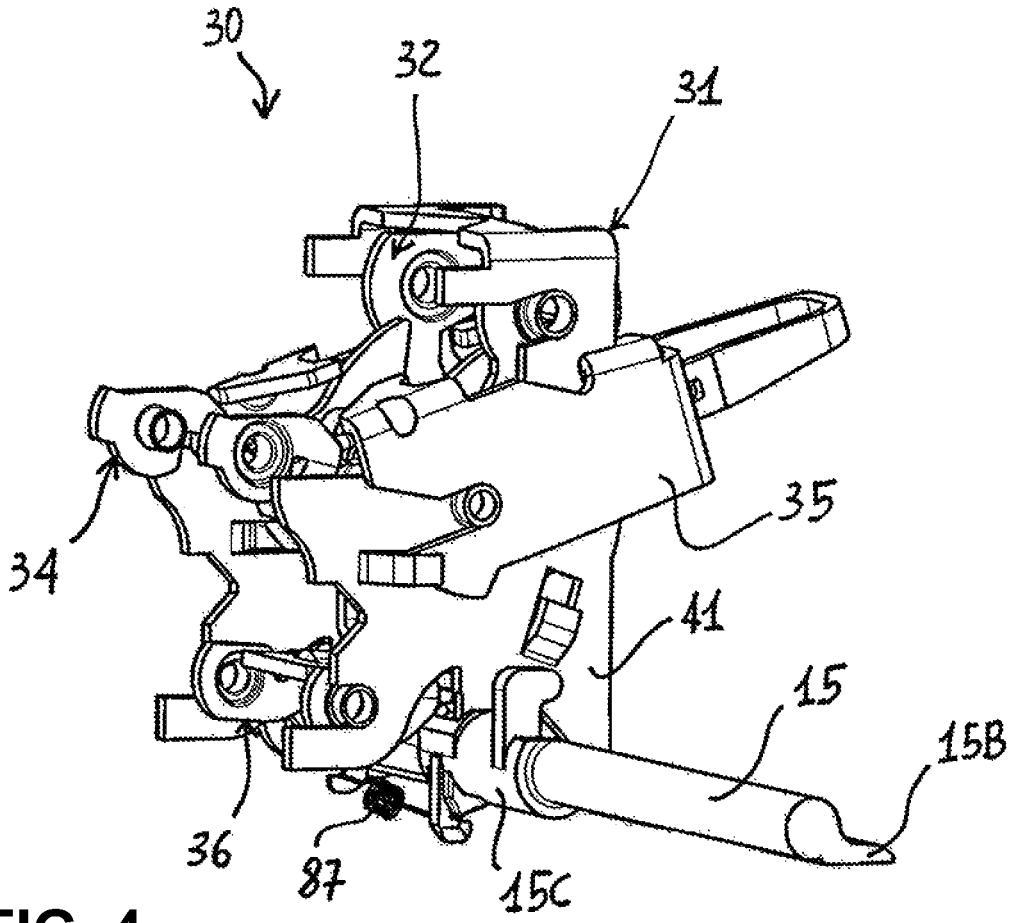
FIG. 4 is a perspective view of a control mechanism for the circuit-breaker according to the invention shown in FIG. 1.

According to a preferred embodiment of the invention shown in FIGS. 3 and 4, the supporting frame 31 is connected to the trip shaft 15. More precisely, the supporting frame 31 is installed on supporting portions 15C of the trip shaft 15, as shown in FIG. 4 for instance. This embodiment has proved particularly advantageous with respect to the majority of conventional solutions in which, in order to establish and maintain the global geometry of the frame, it is essential for the various stages of the control's assembly to take place sequentially and in cooperation with an internal portion of the housing. In the embodiment shown in FIG. 3, the control mechanism 30 is clearly of the "stand alone" or self-supporting type, i.e. it maintains a stable arrangement even when separated from the circuit-breaker housing and it can be separately assembled and subsequently installed in the circuit-breaker in a single step, with obvious advantages especially in terms of practicality and a reduction of the assembly and/or servicing times.

Figure 5:
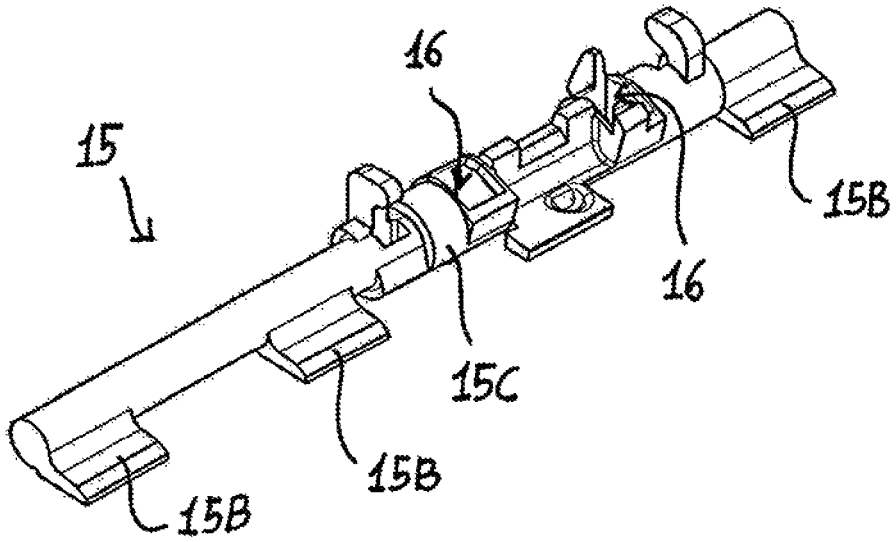
FIG. 5 is a perspective view of a trip shaft in the circuit-breaker shown in FIGS. 1 to 4.

In detail, the supporting frame 31 comprises a pair of pin-shaped connecting ends 81 (see FIG. 6) that each emerge from one of the lateral supporting portions 41 in such a manner as to be aligned with one another. With reference to FIG. 5, the supporting portion 15C of the trip shaft 15 constitutes a pair of cylindrical centring seats 16, in each of which one of the pin-shaped connecting ends 81 of the supporting frame 31 is inserted (e.g. by exploiting the elasticity of the material). More precisely, the centring seats 16 are shaped so as to be coaxial with the axis of rotation of the trip shaft 15. In other words, the insertion of the connecting ends 81 in the centring seats 16 thus defines a pair of hinges that enable the trip shaft 15 to remain free to rotate around its longitudinal axis.

With reference to FIG. 6, the control mechanism 30 comprises a main hook 32, which is operatively connected to the supporting frame 31 by means of first pin-shaped connection means. The structure of the main hook 32 is in the shape of a second pair of lateral portions 42 connected together by a second transverse connecting portion 22. The main hook 32 is connected to the supporting frame 31 by means of first pin-shaped connection means that define a first axis of mutual rotation 101. More precisely, the supporting frame 31 maintains a fixed position during the operation of the control mechanism 30. As a result, the main hook 32 rotates with respect to the supporting frame 31 around the above-defined first axis of mutual rotation 101.

The first pin-shaped connection means comprise a first pair of pin-shaped ends 71 (hereinafter also indicated using the expression first pin-shaped ends 71) that each emerge from one of the lateral portions 42. More precisely, the first pin-shaped ends 71 are made in one piece with a corresponding lateral portion 42 emerging on the outer side of the external portion. The first pin-shaped connection means also comprise a first pair of seats 61 (hereinafter also indicated using the expression first seats 61), in each of which one of the first pin-shaped ends 71 of the main hook 32 is inserted. In particular, as shown in FIG. 6, the first seats 61 are configured so as to enable the insertion of the first pin-shaped ends 71 in a precisely-defined direction. More in detail, according to a first embodiment, these seats are configured substantially in a U shape so that the two parallel sides guide said insertion.

Figure 12:
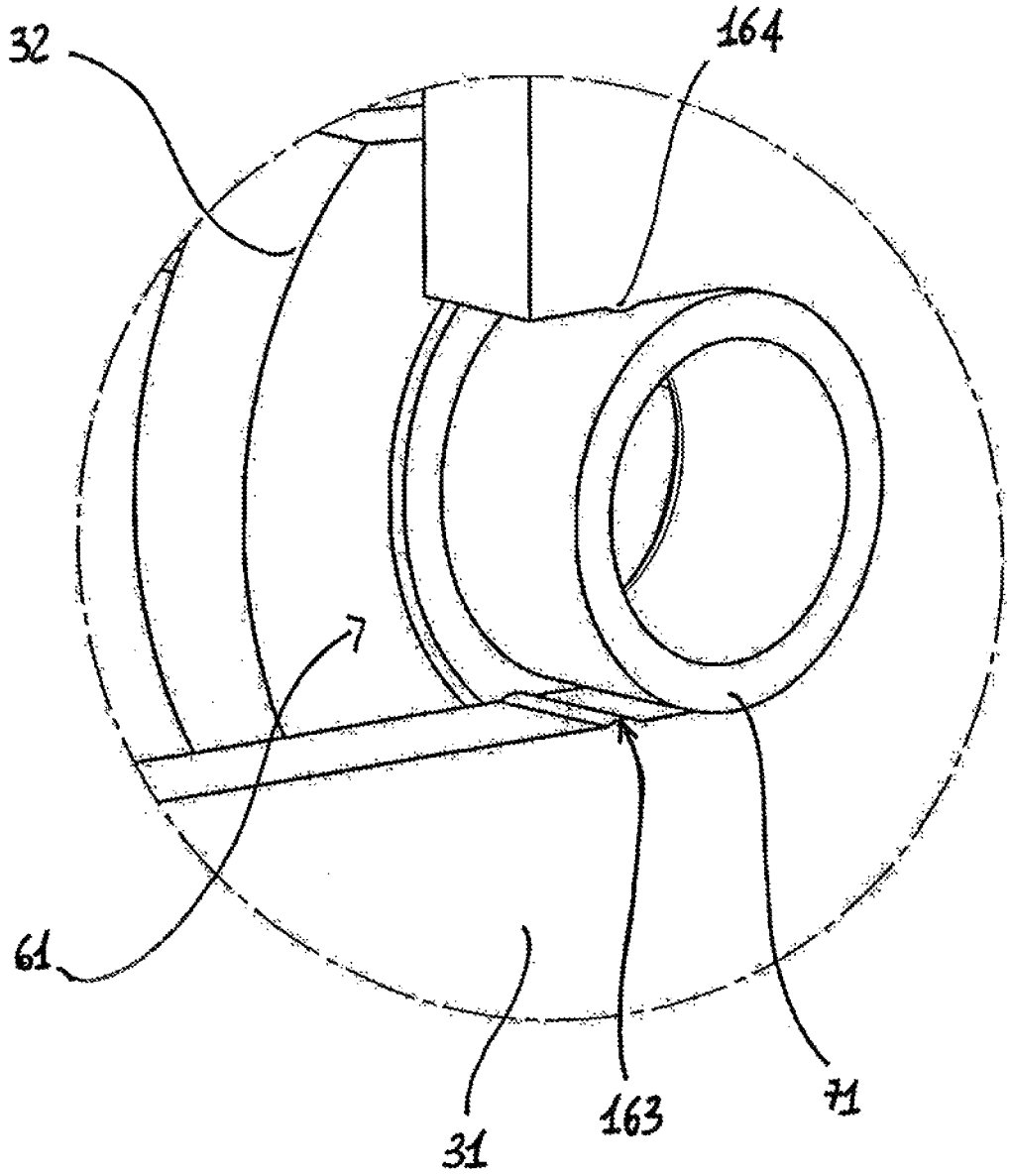
FIG. 12 is a detailed view of the pin-shaped connection means of a control mechanism for the circuit-breaking device according to the present invention.
Figure 13:
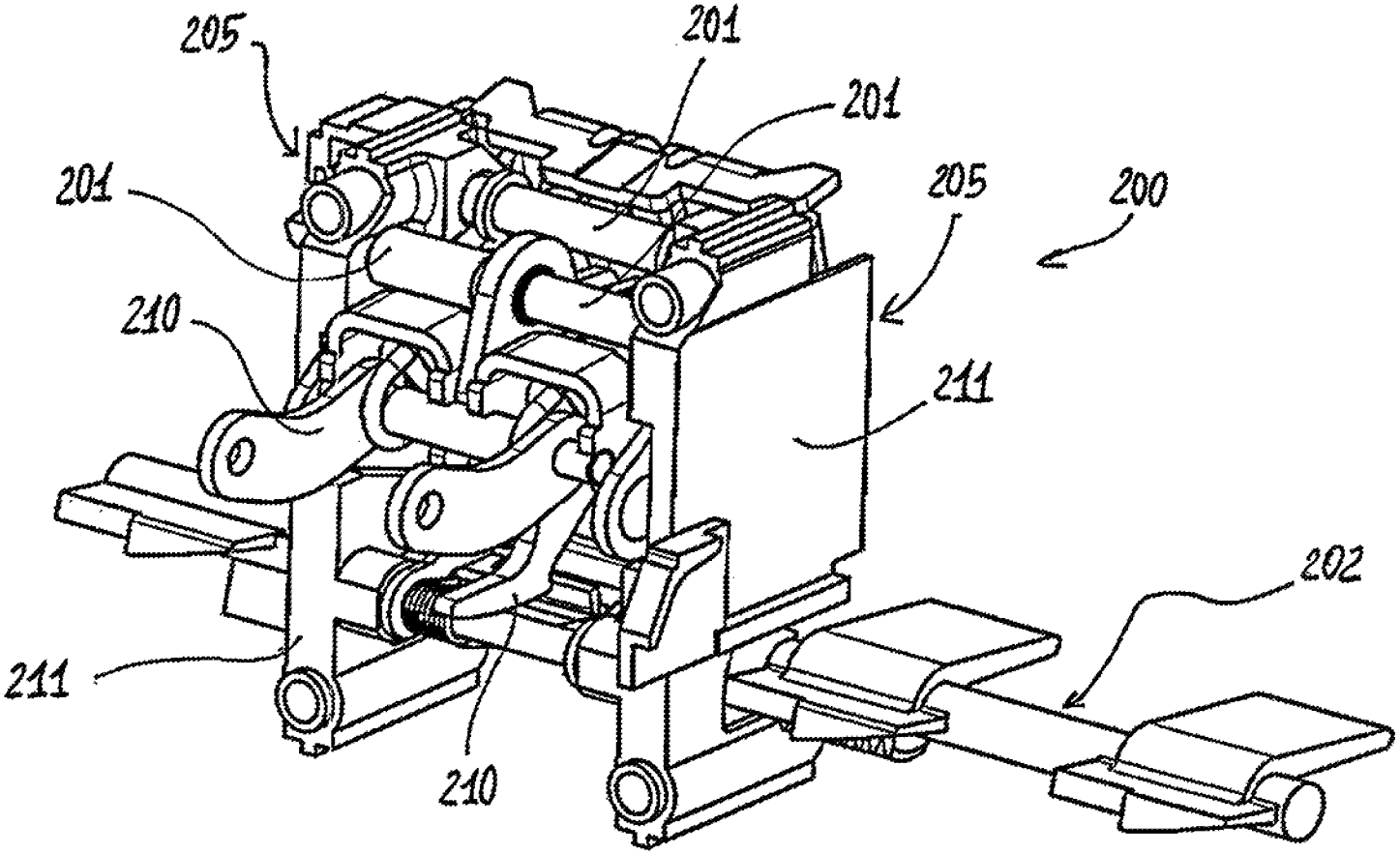
FIG. 13 (PRIOR ART)
FIGS. 13 to 15 are views of control mechanisms of the known state of the art.
Figure 14:
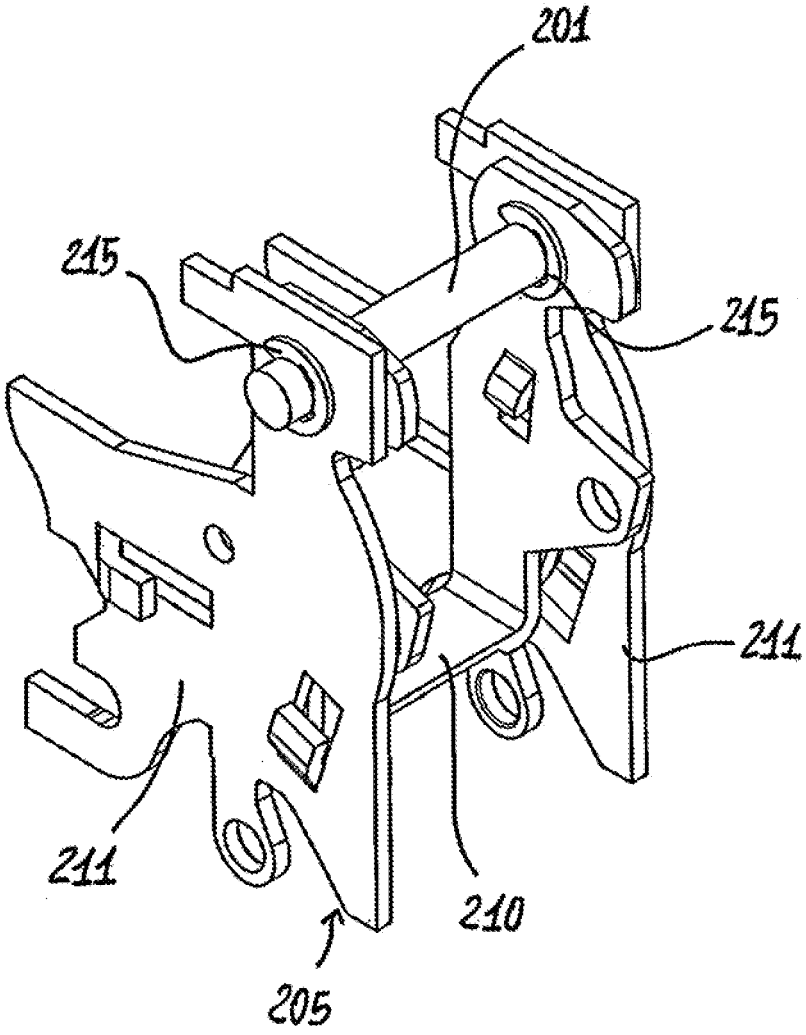
Figure 15:
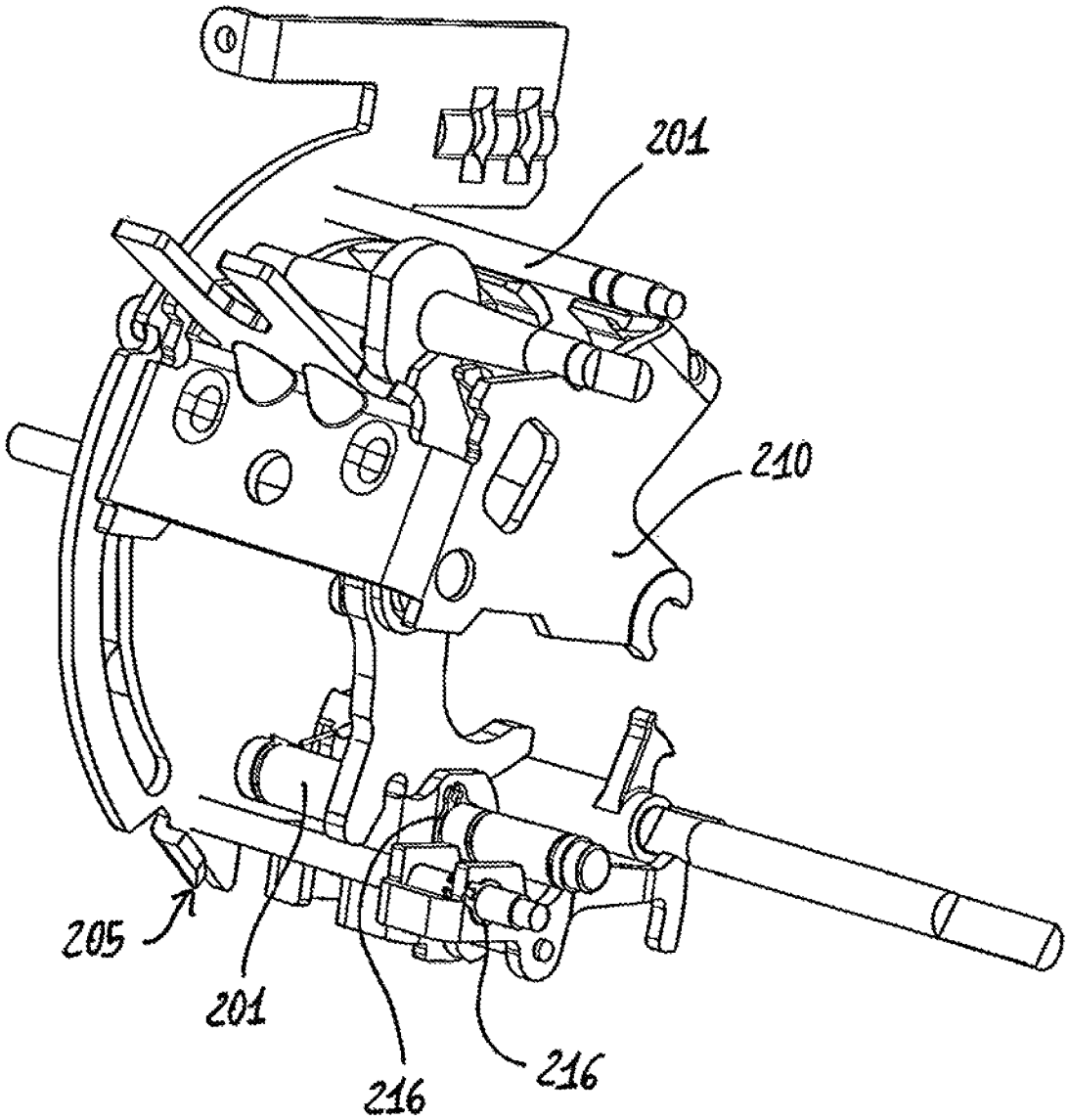

FIG. 12 is a detailed view of one of the pin-shaped ends 71 inserted in a corresponding seat 61. FIG. 12 shows a possible embodiment of the retaining means designed to prevent any separation of the connection during the assembly of the control mechanism 30. These retaining means comprise a first projection 163 and a second projection 164, each emerging from one side of the U-shaped seat. In this embodiment, the pin-shaped ends 71 are inserted using a "click-on" or snapping action, terms used in the sense that the insertion of the pin-shaped ends, or any removal thereof, demands the voluntary application of a limited, but not negligible, force, which suffices to prevent the already-coupled elements from becoming accidentally separated. This aspect of the invention is extremely advantageous in terms of the assembly of the control mechanism 30. In short, this technical solution enables the control to be assembled very rapidly and highly reliably, whether the procedure is done manually, or automatically. In addition, the total absence of any of the retaining elements (plugs, Benzing rings, Seeger rings, etc.) that are used in the conventional solutions, with obvious advantages in both economic and technical terms, given the reduction of the risks relating to the unwanted dispersion of small metal parts inside the circuit-breaker.

In an alternative embodiment to the one shown in FIG. 12 (not shown in the figures), the seat could be configured in a substantially C shape, in which case the retaining means could be advantageously defined by the tips of the "C" shape, suitably shaped and set at a suitable distance so as to enable a "click-on" insertion of the ends in the seats according to a principle similar to the one adopted in the solution in FIG. 12.

With reference once again to FIG. 6, the first seats 61 are defined in a position in the vicinity of the first transverse connecting portion 21 of the supporting frame 31, while the first pin-shaped ends 71 are located in a position substantially remote from the second transverse portion 22 of the main hook 32. The first transverse portion 21 thus faces the second transverse portion 22 of the main hook 32 once the two elements have been connected. Moreover, the lateral portions 42 of the main hook 32 occupy a position in between the lateral portions 41 of the supporting frame 31, i.e. so that the main hook 32 can rotate with respect to the frame 31, within said frame.

The control mechanism 30 shown in the figures comprises a third element 33 hereinafter indicated by the term "fork" 33. The structure of the fork 33 comprises a third pair of facing lateral portions 43 that are connected together by means of a third connecting portion 23. The fork 33 is operatively connected to the main hook 32 by means of second pin-shaped connection means that configure a second axis of mutual rotation 102 (see FIGS. 8 and 9) substantially parallel to the first axis of rotation 101. The second pin-shaped connection means comprise a second pair of pin-shaped ends 72 (hereinafter indicated using the term second pin-shaped ends 72) and a second pair of seats 62 (hereinafter indicated using the expression second seats 62), each of which is suitable for containing one of the second pin-shaped ends 72, which are made in one piece with the main hook 32. Each of the second pin-shaped ends 72 emerges, in a position facing one another, from an internal side of one of the lateral portions 42 of the main hook 32. The second seats 62 are defined instead by the lateral portions 43 of the fork 33. More precisely, the second seats 62 have a substantially U-shaped configuration and are defined in line with first facing terminal parts 43A of the lateral portions 43.

The fork 33 is connected to a fourth operative element 34 in the control mechanism 30, hereinafter indicated using the term "control rod" 34, which comprises a fourth pair of lateral portions 44 transversely connected by a fourth transverse portion 24. The control rod 34 is operatively connected to the fork 33 by means of third pin-shaped connection means, which configure a third axis of mutual rotation 103 (see FIGS. 8 and 9) substantially parallel to the above-defined first 101 and second axes. More precisely, the third pin-shaped connection means comprise a third pair of pin-shaped ends 73 (hereinafter indicated using the expression third pin-shaped ends 73) and a third pair of seats 63 (hereinafter indicated using the expression third seats 63), each of which is suitable for containing one of the third pin-shaped ends 73, which are made in one piece with the control rod 34, and they emerge on facing sides of the fourth transverse portion 24. The third seats 63 are configured substantially in a C shape and are defined on one of the lateral portions 43 of the fork 33. The third seats 63 are located in line with second facing terminal parts 43B of the lateral portions 43. Said second facing terminal parts 43B are substantially opposite the first terminal parts 43A.

The control rod 34 also comprises a second pair of connecting ends 82 made in one piece with the fourth lateral portions 44 so as to occupy mutually facing positions. Each of these second connecting ends 82 emerges from the internal side of a lateral portion and is inserted in corresponding operative seats (not shown) defined on the body of the moving part 50. More precisely, once said second connecting ends 82 have been inserted in the corresponding operative seats, they define an axis of mutual rotation for the control rod 34 in relation to the moving part 50, and vice versa. Said axis is located off-centre with respect to the axis of rotation of the moving part 50. As a result, the displacement of the control rod 34 determines the rotation of the moving part 50 and consequently of the moving contacts 20 contained therein.

The control mechanism 30 comprises a fifth operative element 35, hereinafter indicated using the term "lever-holder element 35", which comprises a fifth pair of lateral portions 45 that are connected by a fifth transverse portion 25 at least partially folded into a U shape. Said fold serves the purpose of supporting a lever 35B extending from the housing 2 of the circuit-breaker 1 once it has been assembled. In practice, the lever 35B constitutes the interface between the control mechanism 30 and its operation from outside the mechanism, which may, for instance, be manual or servo-assisted. As explained in more detail later on, the lever 35B occupies a specific position depending on the operative configuration of the control mechanism 30 (closed, open or tripped). As a result, an operator can ascertain the operative status of the circuit-breaker 1 by observing the position of the lever 35B.

The lever-holder element 35 is operatively connected to the supporting frame 31 by fourth connection means comprising a fourth pair of pin-shaped ends 74 (hereinafter indicated with the term fourth pin-shaped ends 74) that are made in one piece with the supporting frame 31. The fourth connection means also comprise a fourth pair of seats 64 (hereinafter also indicated using the expression fourth seats 64), each of which is defined on one of the fifth lateral portions 45 of the lever-holder element 35. Once the fourth pin-shaped ends 74 have been inserted in the corresponding fourth seats 64, they define a fourth fixed axis of rotation 104 (see FIGS. 10 and 11) parallel to the previously-described axes of rotation. Each of the fourth pin-shaped ends 74 emerges from a corresponding external side of one of the lateral portions 41 of the supporting frame 31 to slot into a corresponding fourth seat 64 configured substantially in a U shape.

As already mentioned above, the control mechanism 30 comprises a tripping element 36 that is operatively connected to the supporting frame 31 by fifth pin-shaped connection means according to the invention. More precisely, the tripping element 36 structurally consists of a sixth pair of facing lateral portions 46, which are connected by a fifth transverse connecting portion 26. The latter comprises a first hooked end 85 that serves the purpose of intercepting a second hooked end (not shown) of the main hook 32.

The fifth pin-shaped connection means comprise a fifth pair of pin-shaped ends 75 made in one piece with the sixth lateral portions 46 of the tripping element 36. More precisely, each of these fifth pin-shaped ends 75 emerges from an external side of one of the lateral portions 46. The fifth connection means also comprise a fifth pair of facing seats 65, each on one of the first lateral portions 41 of the supporting frame 31. Each of the fifth pin-shaped ends 75 is inserted in a corresponding fifth seat 65 so as to configure a fifth fixed axis of rotation 105 enabling the rotation of the tripping element 36.

Figure 10:
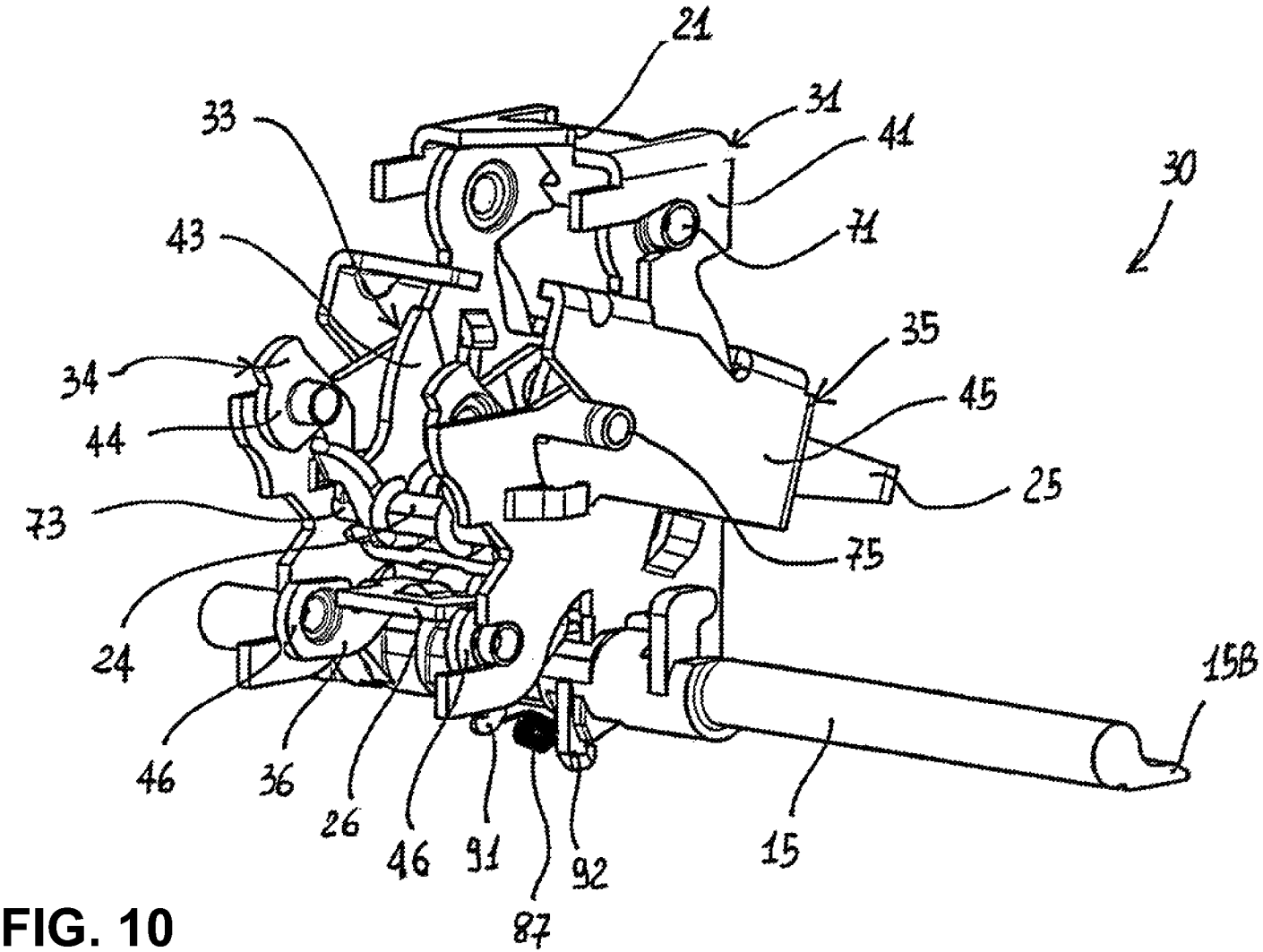
FIG. 10 is a perspective view of the control mechanism in the configuration shown in FIG. 8.
Figure 11:
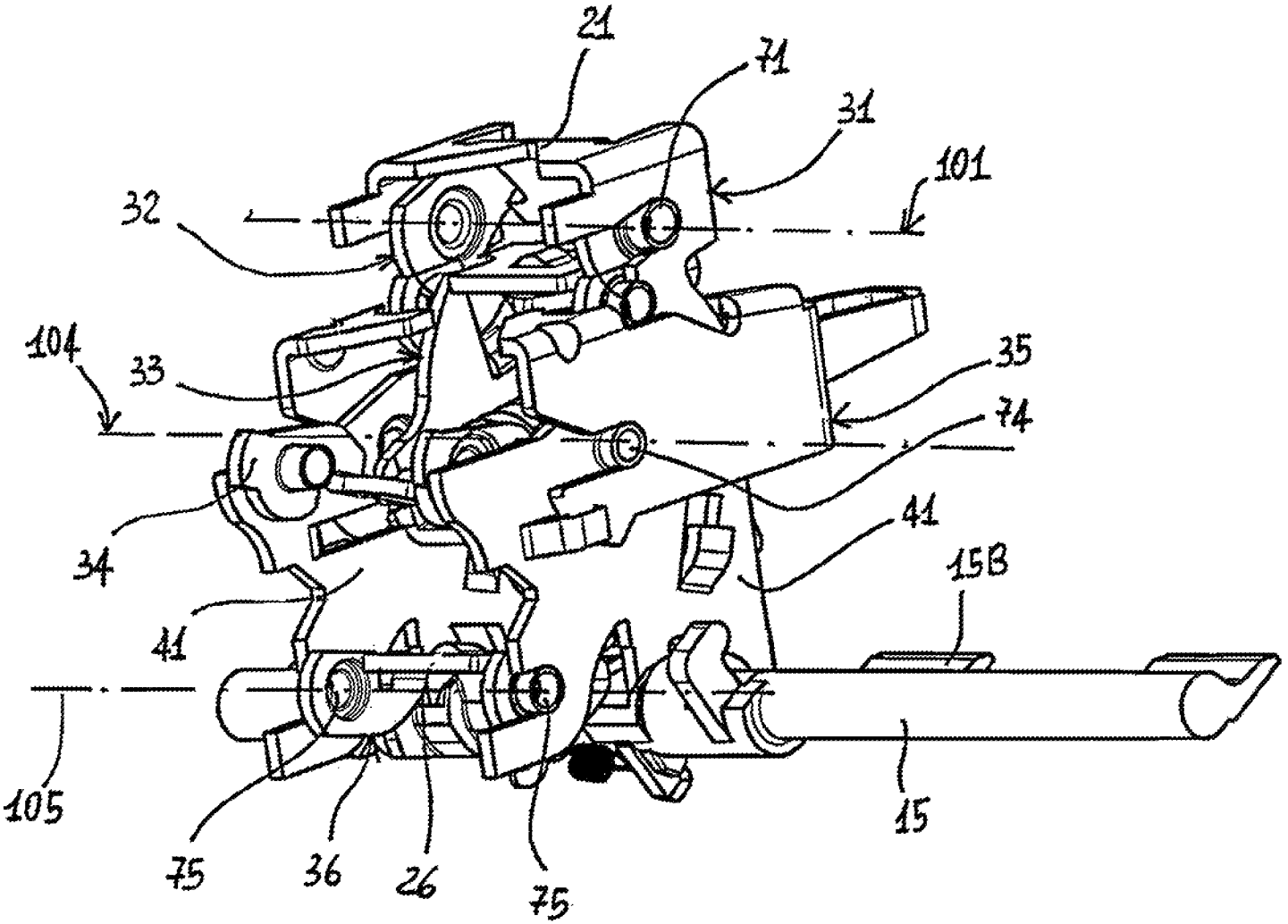
FIG. 11 is a perspective view of the control mechanism in the configuration shown in FIG. 9.

With reference to the perspective view in FIG. 10, at least one of the lateral portions 46 of the tripping element 36 comprises a first enabling end 91, which is operatively connected to a second enabling end 92 emerging from the trip shaft 15. Thus, any rotation of the trip shaft 15 following the tripping of a protection device 135 is translated into a displacement of the first end 92 that withdraws the support for the element 85, prompting a rotation of the tripping element 36 around the fifth axis of rotation 105. The tripping element 36 can thus pass from the hooked position to the released position, on the reaching of which the main hook 32, under the action of the elastic means 37, becomes free to rotate around the first axis of rotation 101. The two enabling ends 91,92 are mutually connected by a return spring 87 that ensures a proper resetting of the device from the tripped position to the open position.

In the embodiment illustrated herein, the elastic means comprise a pair of control springs 37 operatively connected at one end to symmetrical portions of the fourth transverse portion 24 of the control rod 34, and at the other end to symmetrical portions of the fifth transverse portion 25 of the lever-holder element 35. In other words, the two control springs 37 lie parallel to one another and are connected to respective portions of the rod 34 and of the lever-holder element 35 by means of suitable hooks 37B. An elastic force comes to bear on the pin-shaped ends 71,72,73,74,74 of the coupled elements so that they maintain a stable position inside the corresponding seats 61,62,63,64,65 in which they are inserted. In other words, the control springs 37 come to bear on the various elements of the control mechanism 30 so as to keep each element constantly connected to the others. In practice, the control springs 37 exert a force on the various pin-shaped ends 71,72,73,74, with at least one component that is always concordant with the direction in which they were inserted in their corresponding seats 61,62,63,64,65. More precisely, whatever the configuration of the control mechanism 30, the control springs 37 always contribute to the generation of a positive action on the various pin-shaped ends 71,72,73,74,75 designed to keep them inserted in the corresponding seats 61,62,63,64,65.

In the control mechanism 30 the control springs 37 also serve the purpose of providing the mechanism itself with the elastic force needed to accelerate the rotation of the moving part 50, i.e. the opening or closing of the contacts, by means of the control rod 34. A further function of the springs 37 consists in ensuring the necessary pressure of the juxtaposed electric contacts when the circuit-breaker is in the closed position.

The above-described configuration of the elastic means is particularly advantageous in that it exploits the action of kinematic thrust elements (i.e. the control springs 37) to keep the control mechanism 30 stably assembled. This makes it possible, for instance, to widen the range of the tolerance relating to the dimensions of the pin-shaped ends and of the seats, with obvious advantages in terms of the overall manufacturing costs.

Figure 7:
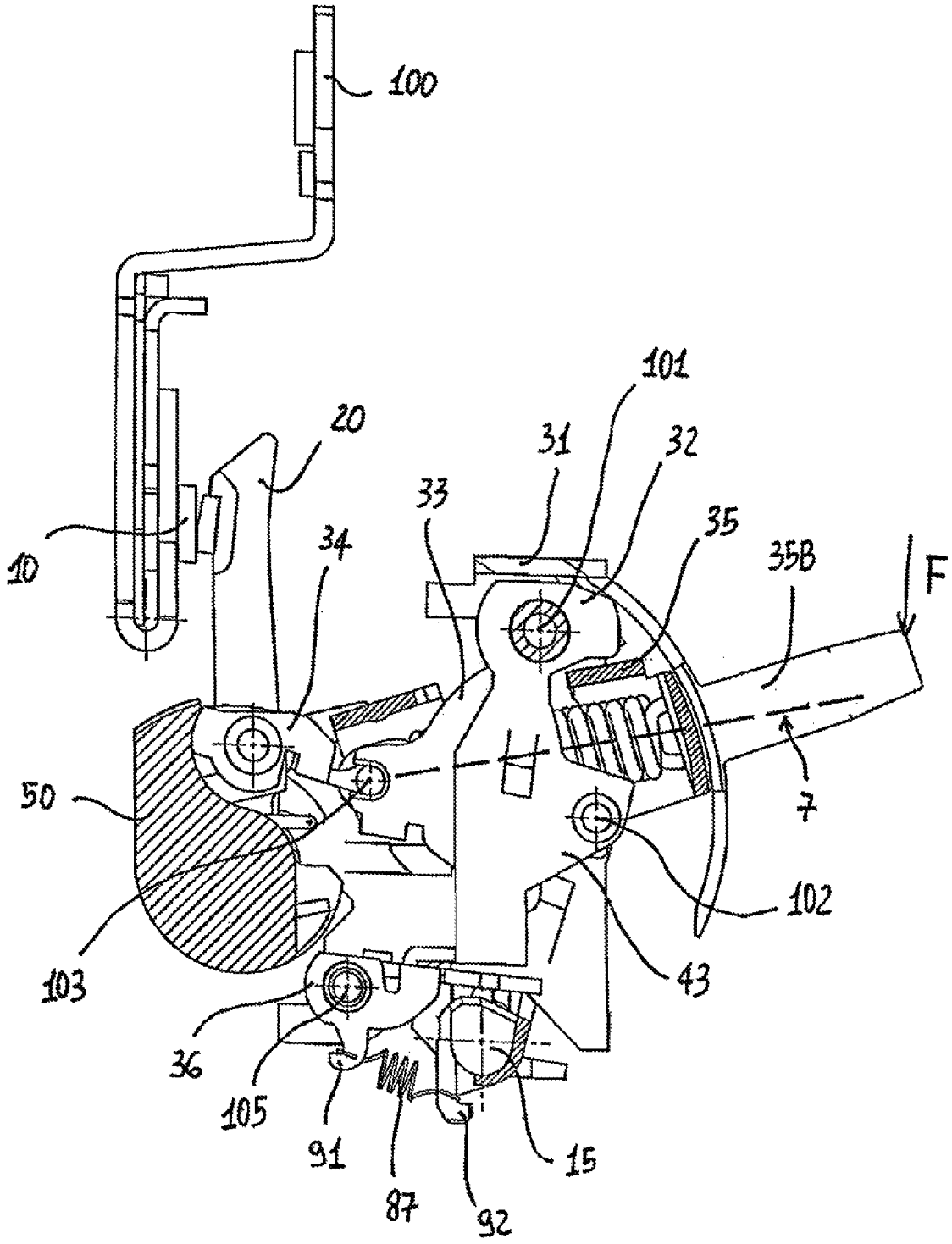
FIG. 7 is a view of the control mechanism shown in FIG. 1 in the closed configuration.

FIG. 7 is a cross-sectional view of the control mechanism 30 shown in a closed configuration, wherein the moving contacts 20 are coupled with the corresponding fixed contacts 10. In this configuration, the control springs 37 are in a state of traction and they exert an elastic force in the direction of a line 7. In practical terms, said line 7 is defined by the points where the control springs 37 engage respectively with the control rod 34 and the lever-holder element 35. The tripping element 36 comes to be in its hooked position to withhold the main hook 32, i.e. to prevent its rotation around the first axis 101.

The passage from the closed configuration of FIG. 7 to the open configuration (shown in FIG. 8) takes place when the lever 36 is operated (as indicated by the arrow F in FIG. 7). This action F induces the rotation of the lever-holder element 35 around the fourth axis of mutual rotation 104 (see FIG. 11). In a first phase of said rotation of the lever-holder element 35, the moving contacts 20 still remain coupled, while the tensile stress on the control springs 37, connected between the lever-holder element 35 and the control rod 34, progressively increases. This condition persists up until the line 7 intersects the second axis of mutual rotation 102 defined by the second pin-shaped connection means that connect the main hook 32 to the fork 33. In this condition, the control springs 37 reach their maximum extension, i.e. their maximum state of traction. As soon as the line 7 drops beyond the second axis of rotation 102, the control springs 37 release the elastic energy accumulated during the first opening phase. This determines a rapid entrainment of the control rod 34 downwards, i.e. in the direction of the tripping element 36, which makes the moving part 50 rotate around its axis of rotation, and this is translated into a rapid separation of the contacts 10,20. At the end of the opening phase, the control mechanism 30 reaches the configuration shown in FIG. 8. Clearly, during the opening phase, the tripping element 36 remains in its hooked position.

It is also clear that the above-described opening movement would not be possible if a traditional hinged joint, consisting of a continuous transverse pin supported by opposite portions of the mechanism, were used instead of the first pair of pin-shaped ends 71. In other words, any transverse pin coinciding with the axis 102 would not allow for the passage of the control springs 37, and the consequent displacement of the lever-holder element 35. From the above description, it is self-evident that eliminating the through pins enables movements that would otherwise be impossible.

Figure 8:
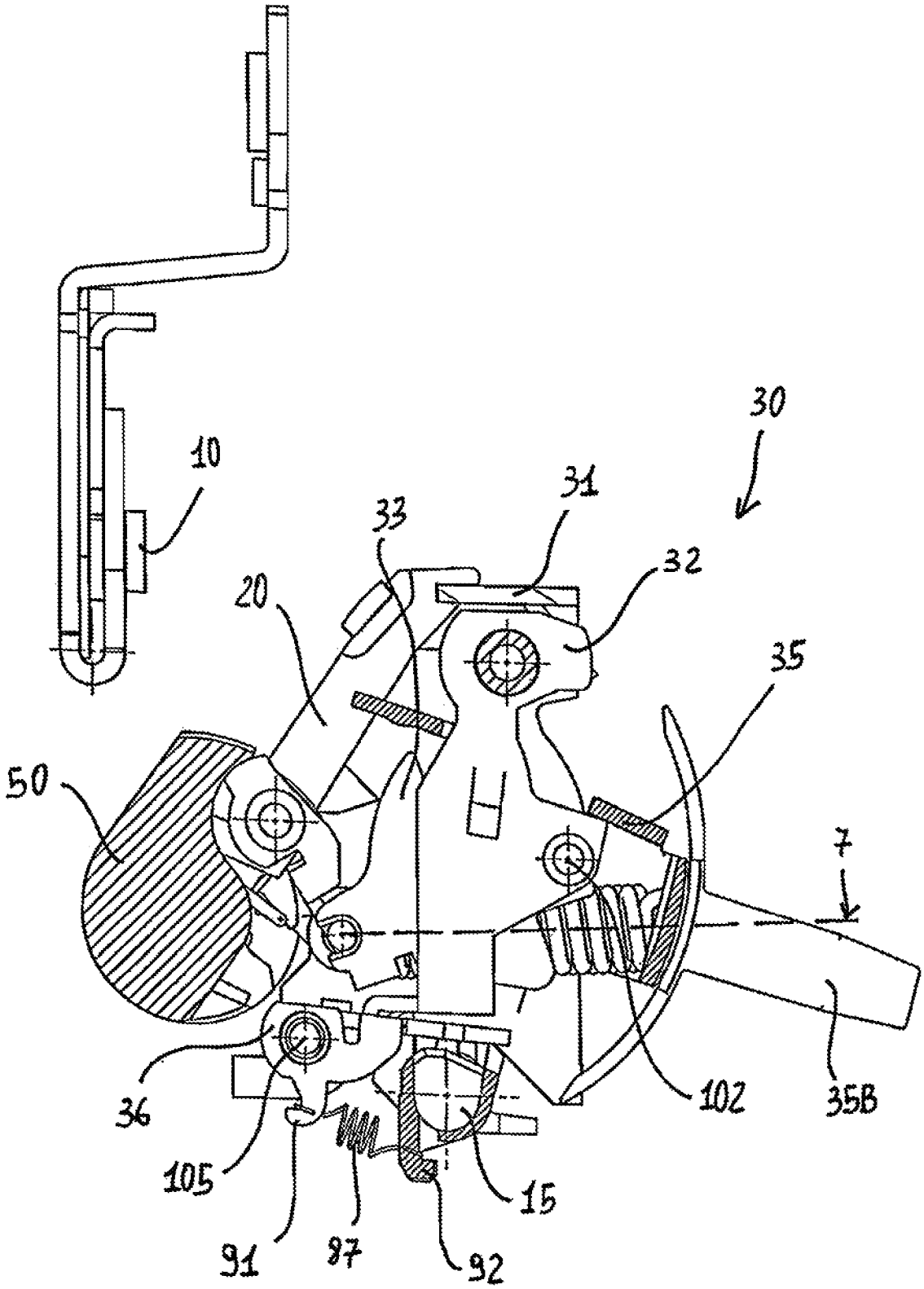
FIG. 8 is a view of the control mechanism shown in FIG. 1 in the open configuration.
Figure 9:
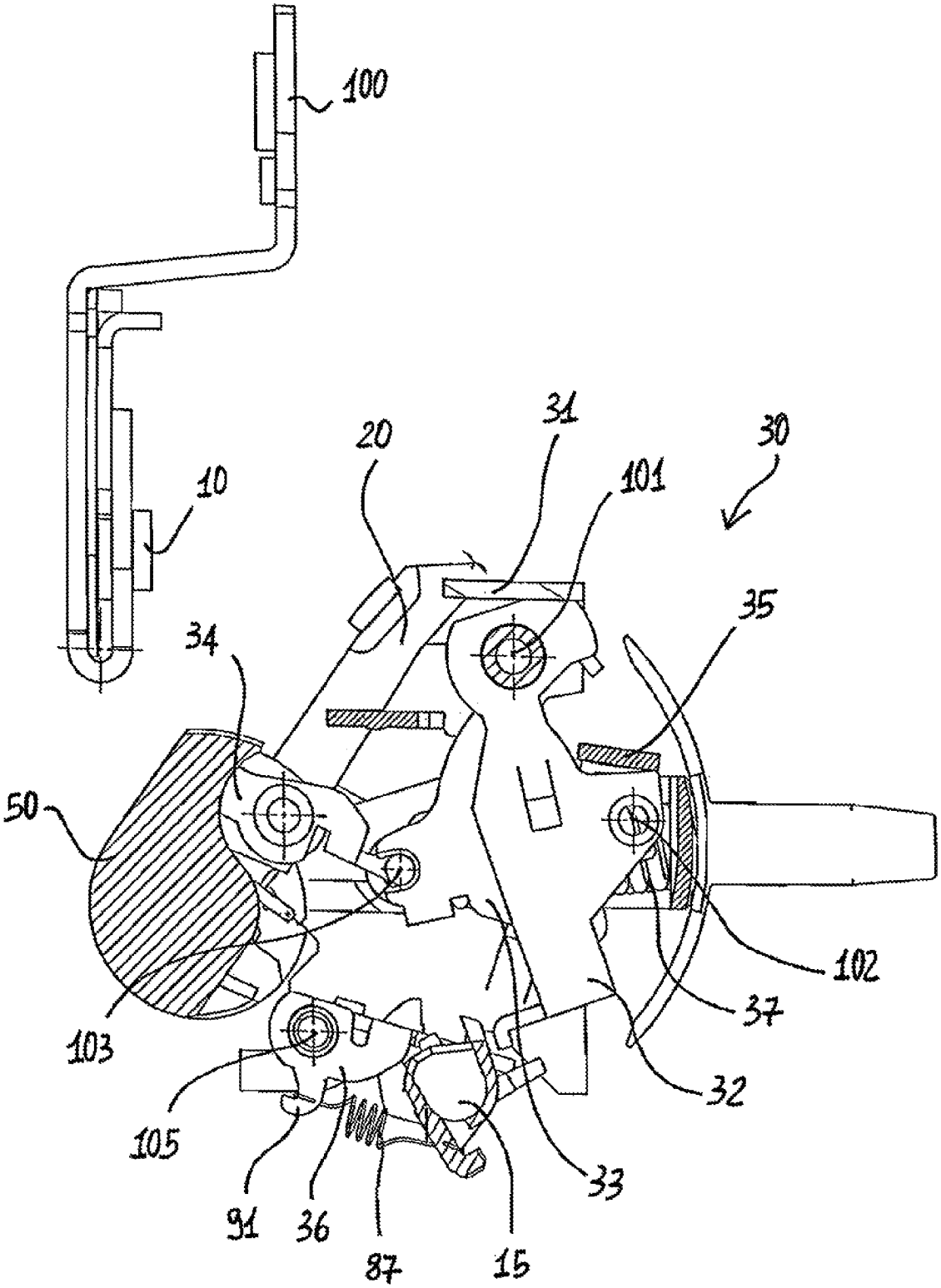
FIG. 9 is a view of the control mechanism shown in FIG. 1 in the tripped configuration.

FIG. 9 shows the control mechanism 30 in its "tripped" configuration. The passage from the closed configuration (in FIG. 7) to the tripped configuration takes place following the enabling of a protection device of the circuit-breaker 1, which causes a rotation of the trip shaft 15. Said configuration can also be achieved following an electrodynamic repulsion of the moving contacts. In fact, the rotation induced in the trip shaft 15 is translated into a rotation of the tripping element 36 around the fifth axis of rotation 105, which brings it into a released position as a result of which the main hook 32 is free to rotate in relation to the supporting frame 31 around the first axis of mutual rotation 101. More precisely, when the main hook 32 is released, the control springs 37 exert a tensile force on the control rod 34 in the direction of the lever 35B. Said tensile force comes to bear on the main hook 32 through the fork 33, prompting the rotation of said hook 32 around the first axis of rotation 101. The consequent entrainment of the control rod 34 causes the rotation of the moving part 50, and thus the sudden separation of the contacts 10,20. The control mechanism 30 thus acquires the configuration shown in FIG. 9, which is evidently different from the one in FIG. 8, showing a manual opening configuration.

The technical solutions adopted for the circuit-breaking device according to the invention fully enable the previously-stated technical aim to be satisfied. In particular, the use of pin-shaped connection means according to the above-described principles increases the reliability of the circuit-breaker, while also simplifying its construction. The circuit-breaking device thus conceived may undergo numerous modifications and variants, all coming within the scope of the inventive concept. Moreover, all the details may be substituted by others that are technically equivalent. In particular, the pairs of the pin-shaped ends and corresponding seats may be functionally exchanged without altering the inventive concept. Similarly, reversing the side from which each pin-shaped end emerges in relation to the corresponding lateral portion has no influence on the inventive concept.

In practice, any materials may be used, of any shape or size, according to need and the state of the art.

The invention claimed is:

1. A control mechanism for the displacement of at least one moving contact of a single-pole or multipolar low-voltage circuit-breaking device, said control mechanism comprising elastic means operatively connectable to said at least one moving contact and comprising a plurality of elements, at least a first of which is operatively connected to a second element by means of pin-shaped connection means, characterized in that said first and said second elements each comprise a pair of facing lateral portions that are connected by a transverse portion, said pin-shaped connection means comprising a pair of pin-shaped ends, each of which emerges from one side of a lateral portion of said first element, and also comprising a pair of seats, each of which is defined on a lateral portion of said second element, each of said pin-shaped ends being inserted inside a corresponding seat so as to configure an axis of mutual rotation between said first and second elements, said elastic means being arranged so as to exert a retaining force on said pin-shaped ends sufficient to keep them coupled with the corresponding seats in which they are inserted;

wherein said first element maintains a fixed position with respect to a housing during the operation of said control mechanism;

wherein said first element in a fixed position is a supporting frame comprising a first pair of lateral portions connected by first transverse connecting portion;

wherein said supporting frame is operatively connected to a trip shaft of said control mechanism;

wherein said mechanism comprises a main hook operatively connected to said supporting frame by means of first pin-shaped connection means that define a first axis of mutual rotation, said main hook comprising a second pair of lateral portions mutually connected by a second transverse connecting portion, said first pin-shaped connection means comprising a first pair of pin-shaped ends that emerge each from one of said lateral portions of said main hook, and a first pair of seats-defined on said lateral portions of said frame, in each of which a first pin-shaped end of said first pair of pin-shaped ends is inserted.

2. A control mechanism according to claim 1, wherein said mechanism comprises a fork operatively connected to said main hook by means of second pin-shaped connection means that define a second axis of mutual rotation, said fork comprising a third pair of facing lateral portions connected together by means of a third connecting portion, said second pin-shaped connection means comprising a second pair of pin-shaped ends and a second pair of seats, each for containing a corresponding pin-shaped end of said second pair of pin-shaped ends, said second pin-shaped ends emerging from an internal side of one of the lateral portions of said main hook, and said second seats being defined on said lateral portions of said fork.

3. A control mechanism according to claim 2, wherein said mechanism comprises a control rod operatively connected to said fork by means of third pin-shaped connection means that configure a third axis of mutual rotation, said control rod comprising a fourth pair of lateral portions connected by a fourth transverse connecting portion, said third pin-shaped connection means comprising a third pair of pin-shaped ends and a third pair of seats, each of which contains one of said third pin-shaped ends, said third pin-shaped ends emerging from facing sides of said fourth transverse connecting portion, and said third seats being defined so as to coincide with second facing terminal parts of said lateral portions of said fork.

4. A control mechanism according to claim 3, wherein said mechanism comprises a lever-holder element operatively connected to said supporting frame-by means of fourth pin-shaped connection means, said lever-holder element comprising a fifth pair of lateral portions connected by a fifth transverse connecting portion that supports a lever, said fourth pin-shaped connection means comprising a fourth pair of pin-shaped ends and a fourth pair of seats, each of which contains a corresponding pin-shaped end, and each of said fourth pin-shaped ends emerges from the external side of a lateral portion of said supporting frame, each of said fourth seats being defined on a lateral portion of said lever-holder element.

5. A control mechanism according to claim 4, wherein said mechanism comprises a pair of control springs operatively connected at one end to said fourth transverse connecting portion of said control rod and at the other end to said fifth transverse portion of said lever-holder element.

6. A control mechanism according to claim 5, wherein said mechanism comprises a tripping element operatively connected to said supporting frame by means of fifth pin-shaped connection means so as to define a fifth axis of mutual rotation, said tripping element comprising a sixth pair of lateral portions connected by a sixth transverse connecting portion, and said fifth pin-shaped connection means comprising a fifth pair of pin-shaped ends and a fifth pair of seats, each of which contains one of said fifth pin-shaped ends that emerge from the external side of a corresponding sixth lateral portion of said tripping element, each of said fifth seats being defined on a corresponding lateral portion of said supporting frame.

* * * * *